US005822444A

United States Patent [19]

Oizumi et al.

[11] Patent Number: 5,822,444

[45] Date of Patent: Oct. 13, 1998

[54] LOUDSPEAKER

[75] Inventors: Hiroya Oizumi; Fumio Murayama, both of Tendo, Japan

[73] Assignees: Pioneer Electronic Corporation, Tokyo; Tohoku Pioneer Electronic Corporation, Yamagata-Ken, both of Japan

[21] Appl. No.: 756,821

[22] Filed: Nov. 26, 1996

[30] Foreign Application Priority Data

Dec. 6, 1995 [JP] Japan ..... 7-344885

[51] Int. Cl.[6] ..... H04R 25/00

[52] U.S. Cl. ..... 381/405; 381/403

[58] Field of Search ..... 381/192, 194, 381/197, 199, 396, 398, 400, 405, 407, 411; 29/594, 609.1

[56] References Cited

U.S. PATENT DOCUMENTS

| | | | |
|---|---|---|---|
| 2,090,025 | 8/1937 | Brennan | 381/197 |
| 2,164,374 | 7/1939 | Barker | 381/197 |
| 2,235,187 | 3/1941 | Willson | 381/197 |
| 3,073,916 | 1/1963 | Williams et al. | 381/197 |
| 3,160,716 | 12/1964 | Luth | 381/197 |
| 4,017,694 | 4/1977 | King | 381/415 |

FOREIGN PATENT DOCUMENTS

| | | | |
|---|---|---|---|
| 405328492 | 12/1993 | Japan | 381/197 |

*Primary Examiner*—Huyen Le
*Attorney, Agent, or Firm*—Sughrue, Mion, Zinn, Macpeak & Seas, PLLC

[57] ABSTRACT

A loudspeaker having a magnetizable pole piece, a voice coil member surrounding the pole piece with a portion of magnetic gap and connected to a vibratable diaphragm, and a damper supporting the voice coil member, is characterized in that an elastic member is provided between the pole piece and the voice coil member in the magnetic gap wherein an elastic member is made of an elastic material having an elastic constant substantially 1.5 times or more than that of the damper. In addition, the elastic material is made of a silicone rubber.

2 Claims, 3 Drawing Sheets

LOUDSPEAKER

BACKGROUND OF THE INVENTION

1. Field of the Invention

The present invention relates to a loudspeaker, and in particular to a damping mechanism for damping a vibrating diaphragm used in the loudspeaker.

2. Description of the Related Art

There is known an electro-dynamic type loudspeaker as shown in its sectional view of FIG. 1. Such an electro-dynamic type loudspeaker has a metallic back-plate to the center of which a cylindrical magnetizable pole piece 4 is attached and, a ring permanent magnet 8 is fixed onto the back-plate at the periphery to surround the pole piece with a space. A magnetizable ring pole plate 7 is mounded onto the top of the magnet 8 to surround the top of the pole piece 4 and thus forms a magnetic gap G between the top of the pole piece 4 and the pole plate 7. A voice coil bobbin 2 carrying a voice coil 6 (voice coil member) is freely inserted to the magnetic gap and is supported outside by a damper 3 which is fixed to a frame 10. The voice coil bobbin 2 is also rigidly connected to the center of a cone 1 of a diaphragm. The diaphragm cone 1 is provided with a center-cap 11 at the center. The opening periphery of the cone 1 is supported by an edge member 9 which is fixed to the frame 10. An electromagnetic effect caused by an electric current passing though the voice coil 6 vibrates the voice coil bobbin 2 to drive the cone 1.

Utilizing such loudspeakers a speaker system consist of various loudspeakers with different frequency bands respectively so that these speakers are allowed to emit sounds suitable for their bands into which a given full frequency band is previously divided. To construct a high performance speaker system with a plurality of the loudspeakers, it is necessary to smoothly overlap their bands. The loudspeakers are separately provided with the overlapped bands in such a manner that the overlapped portions of their bands are attenuated by using an electrical filter network in order to avoid any disorder in the characteristic adjacent to a resonant frequency thereof.

The use of the electrical filter network complicates the speaker system, resulting in an impediment against the low cost manufacture thereof.

SUMMARY OF THE INVENTION

It is, therefore, an object of the invention to provide a loudspeaker having a vibrating diaphragm capable of being mechanically damped at its resonant frequency suitable for constructing a speaker system.

There is provided a loudspeaker according to the invention having a magnetizable pole piece, a voice coil member surrounding the pole piece with a portion of magnetic gap and connected to a vibratable diaphragm, and a damper supporting the voice coil member, characterized in that an elastic member is provided between the pole piece and the voice coil member in the magnetic gap wherein the elastic member is made of an elastic material having an elastic constant substantially 1.5 times or more than that of the damper. In addition, the elastic material is made of a silicone rubber.

The damper of the invention mainly serves to align the voice coil in the center of the magnetic gap. The elastic member mainly serves to mechanically damper the amplitude of the vibrating diaphragm.

The above set forth and other features of the invention will be made more apparent in the ensuing Detailed Description of the Invention when read in conjunction with the attached Drawings.

DETAILED DESCRIPTION OF THE PREFERRED EMBODIMENTS

The preferred embodiments according to the present invention will be described in detail below with reference to the accompanying drawings. The basic elements of construction of the loudspeaker as referenced by the same numerals are the same as those of the prior art and will not described, but the improved portions will be explained in detail.

Figure 2:
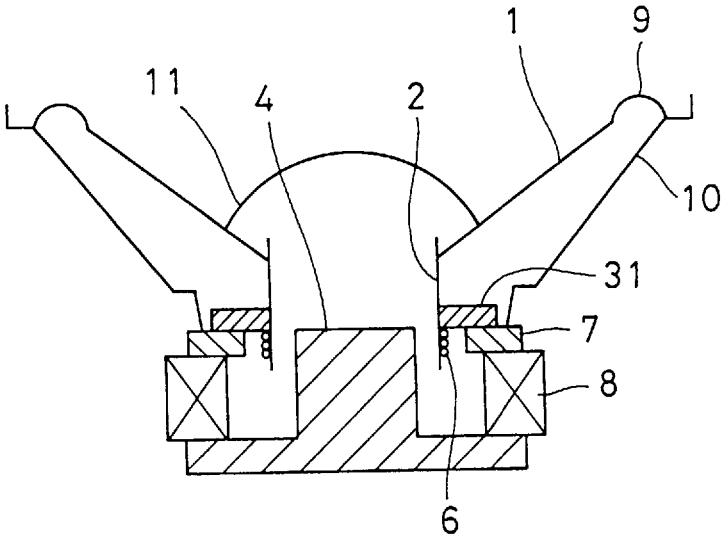
FIG. 2 PRIOR ART
FIGS. 2 and 3 are sectional views showing other loudspeakers respectively.
Figure 3:
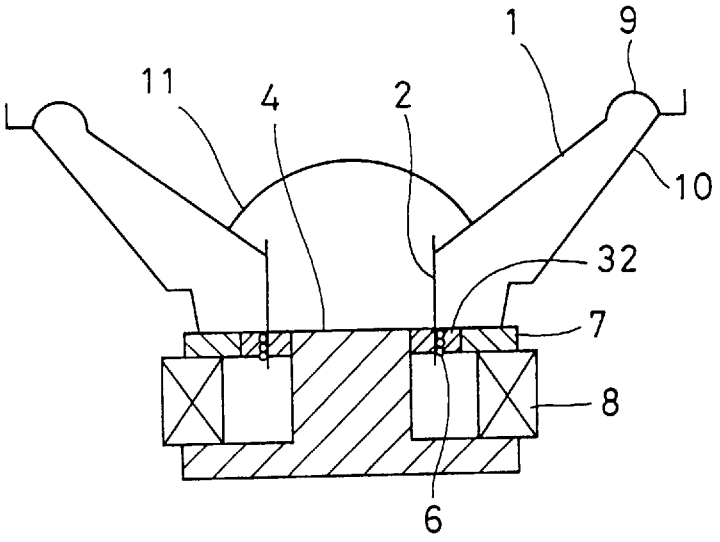
FIG. 3 PRIOR ART

To restrict a disorder adjacent to a resonant frequency at the overlapped portions of their frequency bands in the full audio characteristic, conventional damper constructions for a loudspeaker have been proposed as shown in FIGS. 2 and 3.

Figure 1:
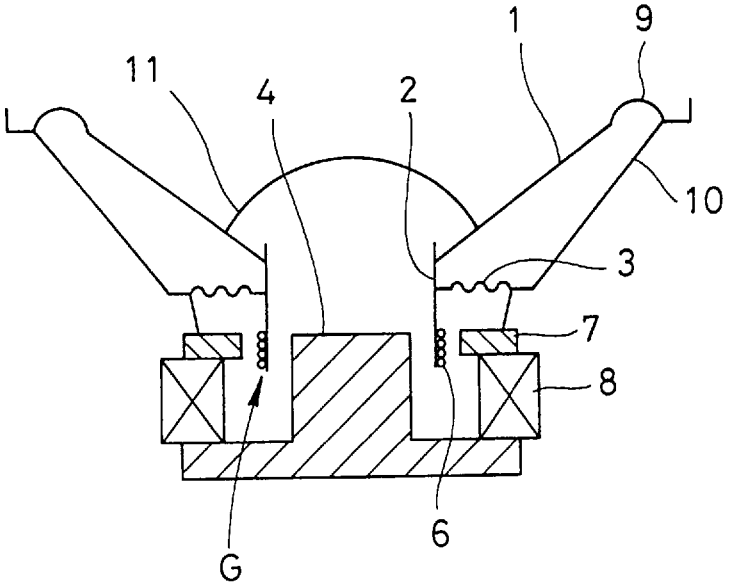
FIG. 1 PRIOR ART
FIG. 1 is a sectional view showing a loudspeaker in the prior art.

In reference to FIG. 2, there is used a damper 31 made of a rubber or the like exhibiting a damping effect instead of the normal damper 3 of FIG. 1. In reference to FIG. 3, there is used a damper 32 made of a silicone rubber with which the magnetic gap is filled entirely instead of the normal damper 3 of FIG. 1.

However, these dampers are problematic. The rubber damper 31 of FIG. 2 requires a high accuracy of shape itself and a strict management to avoid having the cost for the manufacture rise. The filling damper 32 of FIG. 3 requires a long time spent for drying the fluid silicone rubber filled in the narrow magnetic gap and thus it is necessary to hold the voice coil bobbin at a predetermined position in the magnetic gap by using a pertinent support, resulting in a decrease in productivity.

Figure 4:
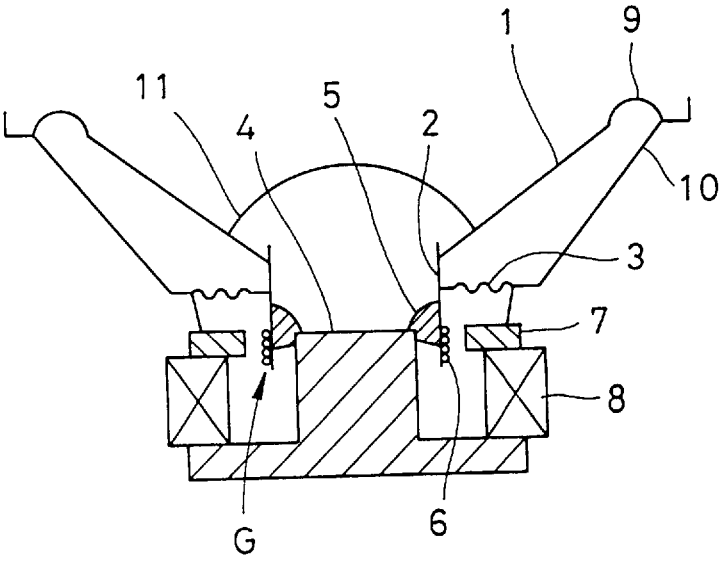
FIG. 4 is a sectional view showing a loudspeaker according to the invention.

A loudspeaker of a cone type according to the invention shown in FIG. 4 overcomes these problems. This loudspeaker is similar to that of FIG. 1 except for further comprising an elastic member 5 which mechanically connects between the periphery edge of the center pole 4 and the inner wall of the voice coil bobbin 2. The damper 3 has in general an elastic constant ranging from approximately 200 to 2,000 N/m. A damper 3 with an approximately 300 N/m elastic constant is used in this embodiment. This damper mainly serves to align the voice coil bobbin in the center of the magnetic gap G and hardly influences mechanically damping the amplitude of the vibrating diaphragm of the loudspeaker. Thus such a damper may be roughly designed.

The elastic member 5 is made of a silicone rubber with an elastic constant ranging from approximately 800 to 20,000 N/m, preferably approximately 11,500 N/m. It should be noted that the silicone rubber used is selected as satisfying the elastic constant of the elastic member 5 being 1.5 times or more than that of the damper 3, so that the amplitude of vibration of the diaphragm is controlled by the elastic member 5 with such a large elastic constant. During the assembling, the elastic member 5 of silicone rubber is provided in fluid form between the periphery edge of the center pole 4 and the inner wall of the voice coil bobbin 2 in the magnetic gap G before adhering the center-cap 11 to the center of the cone diaphragm 1. After that the elastic member 5 is hardened. In this case, since the damper 5 aligns and supports the voice coil bobbin 2 in the center of the magnetic gap during the hardening of the elastic member, the need for using a pertinent support for the bobbin is prevented so that the manufacture is facilitated.

Figure 5:
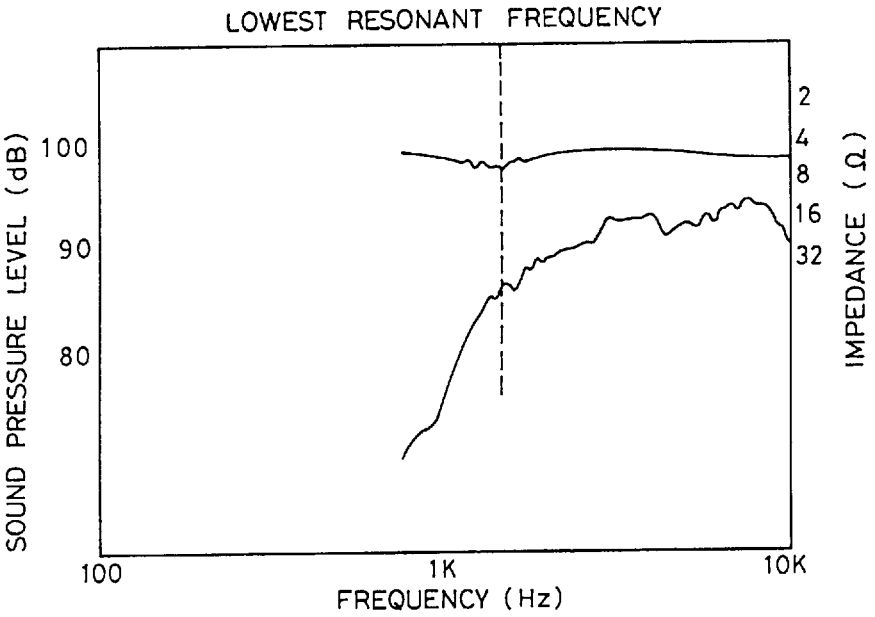
FIG. 5 is an audio spectrum characteristic of a loudspeaker showing a sound pressure level and impedance to frequency-response according to the invention.
Figure 6:
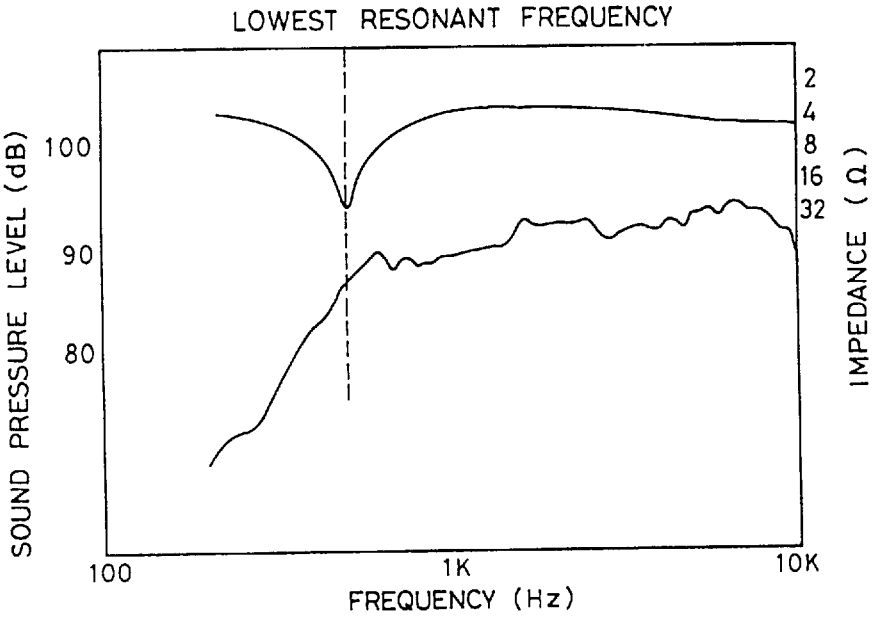
FIG. 6 PRIOR ART
FIG. 6 is an audio spectrum characteristic of a loudspeaker showing a sound pressure level and impedance to frequency-response in the prior art.

FIGS. 5 and 6 show audio spectrum characteristics together with impedance characteristics of loudspeakers of FIG. 4 according to the invention and of FIG. 1 in the prior art respectively. As seen from FIGS. 5 and 6, the loudspeaker of FIG. 4 according to the invention has the damping effect in the range adjacent to the lowest resonant frequency in the audio spectrum characteristics together with impedance characteristics.

To control the amplitude of vibration of the bobbin or diaphragm, the elastic constant is tailored by the selection of the kinds of silicone rubbers so that the lowest resonant frequency in the audio spectrum characteristic is effectively damped. Furthermore, since the silicone rubber in fluid form is provided between the periphery edge of the center pole and the inner wall of the voice coil bobbin immediately before adhering the center-cap to the diaphragm, a loudspeaker according to the invention can be manufactured utilizing the existing facilities for producing loudspeakers and the same process therefor, without lowing the product efficiency thereof.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

What is claimed is:

1. A loudspeaker comprising:

a magnetizable pole piece;

a voice coil bobbin carrying a voice coil surrounding the pole piece and positioned apart from the pole piece in a magnetic gap;

a vibratable diaphragm connected to the voice coil bobbin;

an outer damper having an elastic constant, said damper connected to an outer wall of the voice coil bobbin for supporting the voice coil bobbin during an assembling of the loudspeaker to align the voice coil bobbin in a center of the magnetic gap; and an internal elastic member connected between a periphery edge of the pole piece and an inner wall of the voice coil bobbin disposed in the magnetic gap, wherein the elastic member is made of an elastic material having an elastic constant substantially 1.5 times or more than the elastic constant of the damper, whereby the elastic member controls an amplitude of vibration of the diaphragm.

2. A loudspeaker according to claim 1, wherein said elastic member is made of a silicone rubber which is provided as a fluid between the periphery edge of the pole piece and the inner wall of the voice coil bobbin and then hardened during assembly of the loudspeaker.

* * * * *